United States Patent [19]

Ulveling et al.

[11] 4,227,682

[45] Oct. 14, 1980

[54] GUIDE AND SUPPORT STRUCTURE FOR FURNACE TAPHOLE PLUGGING OR DRILLING DEVICE

[75] Inventors: Léon Ulveling; Pierre Mailliet, both of Howald; Jean Metz, Luxembourg, all of Luxembourg

[73] Assignee: Paul Wurth, Luxembourg, Luxembourg

[21] Appl. No.: 943,224

[22] Filed: Sep. 18, 1978

[30] Foreign Application Priority Data

Dec. 22, 1977 [LU] Luxembourg ..... 78756

[51] Int. Cl.[3] ..... C21C 5/48

[52] U.S. Cl. ..... 266/271; 266/273; 408/237

[58] Field of Search ..... 266/271, 272, 273, 44; 248/395, 398, 415, 416, 425; 408/236, 237

[56] References Cited

U.S. PATENT DOCUMENTS

| | | | |
|---|---|---|---|
| 3,549,141 | 12/1970 | Zimmermann et al. | 266/273 |
| 3,765,663 | 10/1973 | Legille et al. | 266/273 |
| 4,097,033 | 6/1978 | Mailliet | 266/271 |

*Primary Examiner*—L. Dewayne Rutledge
*Assistant Examiner*—Peter K. Skiff

[57] ABSTRACT

An apparatus for guiding and positioning the tool of a machine for plugging or drilling blast furnace tapholes, the apparatus comprising an inclined main pivot, a support arm which is rotatably mounted at one end on the inclined main pivot and having a tool pivotally fitted by an auxiliary pivot to the free end of the support arm, a guide rod mounted to the working tool and mounted to a fixed point in the vicinity of the main pivot, and a driving mechanism serving to pivot the tool and the support arm about the main pivot from a retracted position to an operational position, the longitudinal axis of the auxiliary pivot being oblique with respect to the longitudinal axis of the main pivot to provide for a low profile trajectory of the working tool.

12 Claims, 9 Drawing Figures

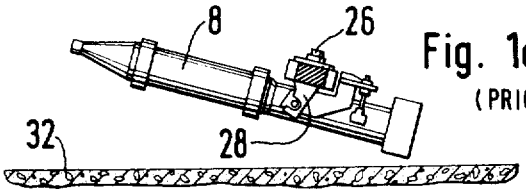
Fig. 1a
(PRIOR ART)
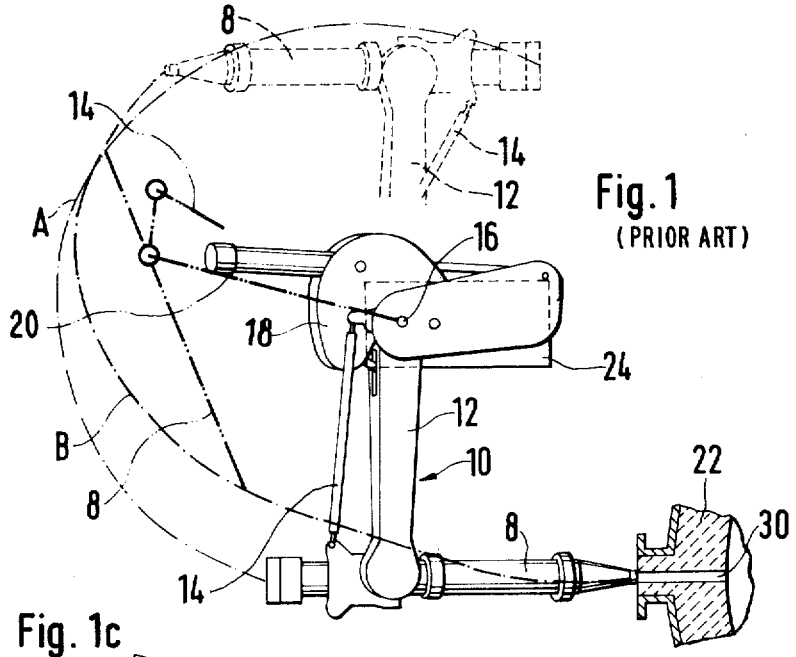
Fig. 1
(PRIOR ART)
Fig. 1c
(PRIOR ART)
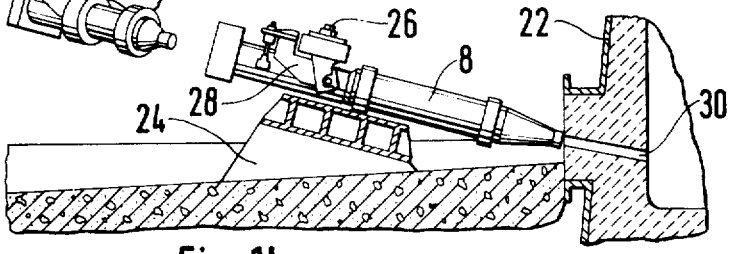
Fig. 1b
(PRIOR ART)

GUIDE AND SUPPORT STRUCTURE FOR FURNACE TAPHOLE PLUGGING OR DRILLING DEVICE

The present invention relates to the plugging and drilling of tapholes of blast furnaces. More specifically, this invention is directed to an apparatus for plugging or drilling tapholes of blast furnaces.

While not limited thereto in its utility, the present invention is particularly well suited for use in plugging and drilling tapholes of blast furnaces. Plugging devices, known in the art as "clay guns," are used to plug tapholes with clay. Such a device is disclosed in U.S. Pat. No. 3,765,663. Drills are used to bore the taphole to allow the molten mass within the blast furnace to exit the blast furnace. An example of such a drilling device is disclosed in U.S. Pat. No. 4,097,033.

The present trend is to drill tapholes having a gradient with respect to the horizontal floor on which the drill or plugging device is located. The tapholes are drilled at an angle between about 8 degrees and 15 degrees and in some instances, angles exceeding 15 degrees with respect to the horizontal. The drill, in its operative position, therefore has to slant to a corresponding extent, and the mechanism for its displacement must be designed to move it into this position in relation to the horizontal.

Although it is not necessary for the angle at which the drill is inclined in relation to the horizontal to be exactly the same as the angle of the taphole, this should nevertheless preferably be the case, so that any variations in the position of the taphole can be more easily allowed for. Since, moreover, the taphole terminates inside the tap spout, which is delimited be comparatively deep lateral flanks, the nose of the clay gun has to descend into the tap spout during the plugging operation, so that the gun should preferably be inclined at a sufficient angle to ensure that its rear part, including the hydraulic jack, will not be too close to the molten cast iron flowing in the said tap spout.

Up to the present this angle of inclination for the drill or clay gun has been obtained by inclining the main pivot in the direction of the furnace by an angle approximately equal to the angle of inclination of the taphole, which means that the drill and the clay gun are displaced in an oblique plane situated in the prolongation of the axis of the tapping hole.

This relatively steep gradient of the path of movement of the working tool nevertheless creates problems, particularly in the retracted position and during the displacement phase. As regards this latter, the engagement and retraction of the working tool over a comparatively steep gradient can only be effected when the working platform positioned around the furnace is either sufficiently narrow or discontinuous, to give passage to the clay gun or to the drill. In either case, the usefulness of the working platform is thereby reduced.

As regards the retracted position, particularly when it is 180° away from the operative position, the drawback arises from the difficulty of access to the front part of the working tool. The fact is that if the rear portion, e.g. of the clay gun is situated low down, its nose will be very high up, precisely owing to the angle of inclination of the main pivot. With a clay gun of 5 m in length, for example, the height of the nose above the pouring floor will render access difficult, which causes difficulties not only as regards access to the nose of the clay gun but also as regards the operation of charging the clay chamber.

This steep gradient of the plane swept by the drill or clay gun nevertheless offers the advantage that the movement is not impeded by any obstacle. This is particularly the case in the system proposed in copending U.S. Application Ser. No. 943,223, in which the plugging device and the drill are situated side by side, the clay gun being above the drill when moving between its retracted and operative positions. A steep inclination of the plane swept by the working tool, on the other hand, might cause the latter to ascend to an excessive height, thus presenting an obstacle at the level of the frame or the working platform.

The purpose of the present invention is to enable a mechanism of the type described above to be improved in such a way as to eliminate these drawbacks without sacrificing the advantages obtained, or in other words, to provide a mechanism for guiding and positioning the working tool in such a way that it wll not constitute an obstacle for the working platform and vice versa, at the same time remaining compatible with the angle of inclination adopted for the tapping hole, that its retracted position will be low down and easily accessible and that the path of movement between its two extreme positions will be one which enables the obstacles present thereon to be negotiated.

According to the present invention there is provided a mechanism for guiding and positioning a working tool such as a clay gun or a drill which operates on the taphole of a shaft furnace, comprising an inclined main pivot, a jib consisting of a supporting arm which is rotatably mounted on the said inclined main pivot and of which the free end is fitted with the working tool via an auxiliary pivot, as well as a guide rod mounted between the working tool and a fixed point in the vicinity of the main pivot and a driving mechanism serving to pivot the working tool and the supporting arm about the main pivot from a retracted position to an operative position and vice versa, wherein the longitudinal axis of the auxiliary pivot is oblique in respect of the longitudinal axis of the main pivot.

In one advantageous embodiment of the invention the longitudinal axis of the auxiliary pivot is inclined, when the working tool is in the operative position, in a vertical plane passing through the axis of the taphole. In the phase in which the supporting arm is in motion the working tool forms at each moment a different specific angle with the said arm. This angle is determined by the characteristics of the guide rod, such as its length and points of application. As the longitudinal axes of the main pivot and the auxiliary pivot differ from each other and as the angle between the working tool and the supporting arm constantly varies throughout the supporting arm displacement phase, the nose of the said tool moves in a different plane from that of the end of the arm.

In a further embodiment of the invention, in addition to the inclination in a vertical plane passing through the axis of the taphole, the longitudinal axis of the auxiliary pivot is likewise inclined in a plane perpendicular to the longitudinal axis of the working tool.

The direction taken by the inclination of the pivot of the working tool is preferably the same as that of the main pivot when the said tool occupies its operative position. The inclination of the tool, in its operative position, is therefore equal to the sum of the angles of inclination of each of the two pivots. Thanks to this supplementary inclination obtained by the pivot of the working tool the inclination of the main pivot can be reduced without reducing that of the working tool in its operative position. In other words, the working tool, in approaching and moving away from its operative position, follows a less sudden gradient, i.e. a lower trajectory, this being more compatible with a sufficiently wide and unobstructed working platform around the furnace.

The inclination of the working tool in the retracted position is equal to the difference in the angles of inclination of the two pivots, so that, if these two angles of inclination are equal, their effects cancel each other out and the tool occupies a horizontal and low position.

Further features and characteristics of the invention will emerge from the following description of an embodiment thereof, given by way of an example, without any limitative effect and by reference to the accompanying drawings, wherein:

FIG. 1 shows a plan view of a known plugging device such as described in U.S. Pat. No. 3,765,663;

FIG. 1*a* shows a side view of the clay gun of the taphole plugging device shown in FIG. 1 in the retracted position;

FIG. 1*b* shows a side view of the clay gun of FIG. 1 in the operational position;

FIG. 1*c* shows a perspective view of the clay gun in the intermediate position as shown schematically in FIG. 1 in broken lines;

Figure 5:
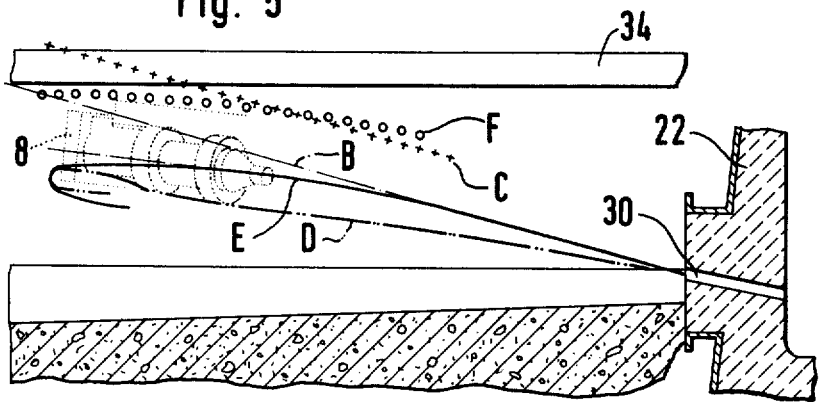
Figure 6:
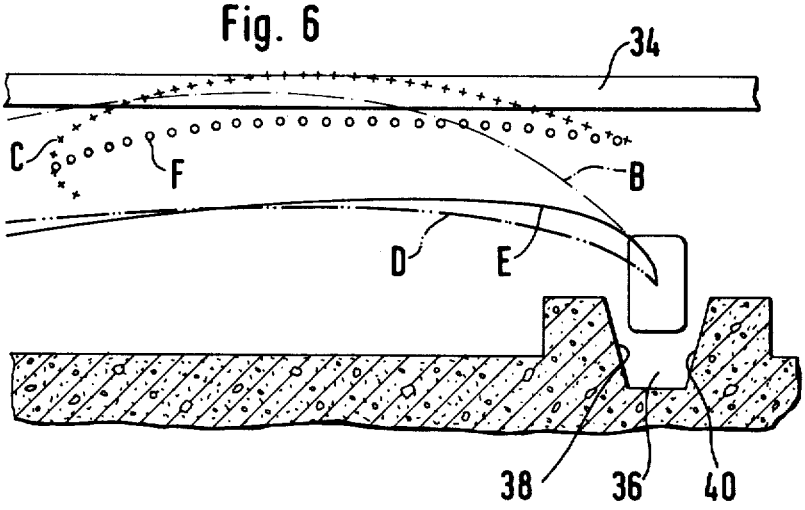

FIG. 5 shows curves defined by the movement of a clay gun by a conventional guide mechanism and curves defined by movement of clay gun by a guide mechanism according to the present invention, the view shown being in a direction perpendicular to the axis of the taphole; and FIG. 6 shows curves defined by the movement of a clay gun by a conventional guide mechanism and curves defined by movement of a clay gun by a guide mechanism according to the present invention, the curves being viewed in a direction perpendicular to the view shown in FIG. 5.

The following detailed description will refer, for the purpose of simplification, to a plugging device. It is obvious, however, that the invention is likewise applicable to a drilling machine. All that is then required is to assume that the clay is replaced by a drill.

FIG. 1 shows in full lines a prior art type taphole plugging device in the operative position wherein clay may be injected into the taphole. This plugging device consists of a clay gun 8, a jib 10 formed by supporting arm 12 and by guide rod 14, and a main pivot 16 inclined toward furnace 22 which is shown schematically. A hydraulic jack 24, connected to arm 12 via a U-shaped stirrup piece 18, provides for movement of the entire assembly about concrete stand 24. U.S. Pat. No. 3,765,663 includes a more detailed description of the construction and operation of this prior art taphole plugging device. In the example shown in FIG. 1, the clay gun 8 is movable through an angle of 180° between an operative position (slown in full lines) and a retracted position (shown in broken lines). Clay gun 8 is suspended from support arm 12 by fork 28 and pivot 26, pivot 26 being hereinafter termed the auxiliary pivot. The longitudinal axis of the auxiliary pivot 26 is parallel to the longitudinal axis of the main pivot 16 so that the clay gun is movable through a planar surface. During pivotal movement about main pivot 16, clay gun 8 performs an additional pivotal movement about its auxiliary pivot 26 as a result of the action of guide rod 14. The two ends of clay gun move through curves indicated by A and B, curves A and B not being circular but being of a particular shape determined by the length of the guide rod 14. The length of guide rod 14 is adjustable thereby allowing for selection of the desired trajectory, and, in particular the selection of curve B so that the nose of clay gun 8 in the operational position is in an imaginary prolongation of the axis 30 of the taphole.

In order to place the clay gun 8 in the operative position, in the prolongation of the axis of the taphole, the main pivot 16 is inclined in the direction of the furnace 22 by an angle equal to that at which the said taphole 30 is inclined. In their movement from the retracted position to the operative position and vice versa the clay gun 8 and the supporting arm 12 therefore sweep an inclined plane situated in the prolongation of the axis of the taphole 30 and perpendicular to the longitudinal axis of the main pivot 16. The longitudinal axis of the clay gun 8 remains constantly in the said inclined plane, so that in the retracted position shown in FIG. 1 the gun is inclined at a considerable angle, impeding access to the nose of the gun, which may be situated, according to the length, up to 2 m from the pouring floor marked 32.

FIG. 1*c* shows an intermediate position of the clay gun, corresponding to the position shown schematically in heavy lines in FIG. 1. As may be seen from FIGS. 1*b* and 1*c*, the inclination of this pivoting plane rapidly moves the gun to a level which is a considerable distance above the pouring floor and may constitute an obstacle to the frames or the operating floor, not shown in this drawing.

Figure 2:
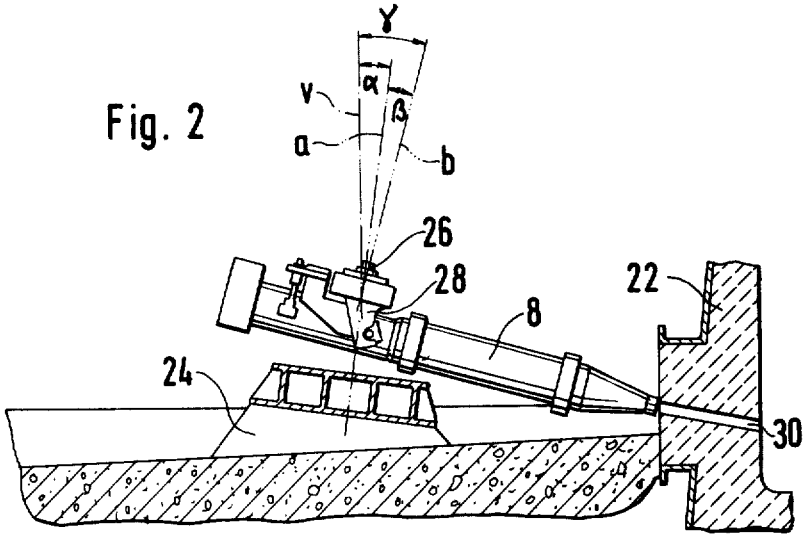
FIG. 2 shows a side view of the mechanism for guiding and positioning a tool, the tool being shown in the operational position.

Referring to FIG. 2, a clay gun 8 according to the invention is shown in operational position. However, it should be understood that gun 8 may be replaced by another suitable tool, such as, for example, a drill. In the mechanism shown in FIG. 2, the angle of inclination of the axis "a" of the main pivot in relation to the vertical, "v", is represented by angle $\alpha$ which is smaller that the angle of inclination of the axis of taphole 30 with respect to the horizontal. The axis "b" of the auxiliary pivot 26 is inclined at an angle of $\beta$ with respect to the axis "a" of the main pivot. In the embodiment shown in FIGS. 2 and 3, the angle of inclination, $\alpha$, of main pivot and the angle of inclination $\ominus$ of auxiliary pivot 26 are in the same direction: as shown in FIG. 2 both axes slant toward the furnace. When the tool is in the operational position as shown in FIG. 2, angles of inclination $\alpha$ and $\beta$ are added together to provide an angle of inclination $\alpha$ of axis "b" with respect to the vertical. The angle of inclination $\alpha$ defines the angle of inclination of the tool with respect to the horizontal. In the embodiment of the invention shown in FIGS. 2 and 3, the angle of inclination of tool with respect to taphole 30 may be inclined at the same angle with respect to the horizontal as the version shown in FIGS. 1, 1A, 1B and 1C without the main pivot 16 being required to assume a relatively large angle of inclination. Because the angle of inclination is reduced, the movement pattern or path of the tool has a lower profile as will be further described with respect to FIG. 5.

This system offers the advantage that the plane swept by the supporting arm 12 is only inclined by an angle $\alpha$ in respect of the horizontal, i.e. that its gradient is less steep. On the other hand, the gun 8, during the movement of the arm 12, sweeps an auxiliary plane inclined by an angle $\beta$ in respect of the main plane swept by the supporting arm 12. In other words, the clay gun 8, during its movement from the operative position to the retracted position and vice versa, performs a higly complex movement consisting of a rotation with the supporting arm 12 about the axis "a" of the main pivot 16, combined with a rotation about the axis "b" of its own auxiliary pivot 26.

Figure 3:
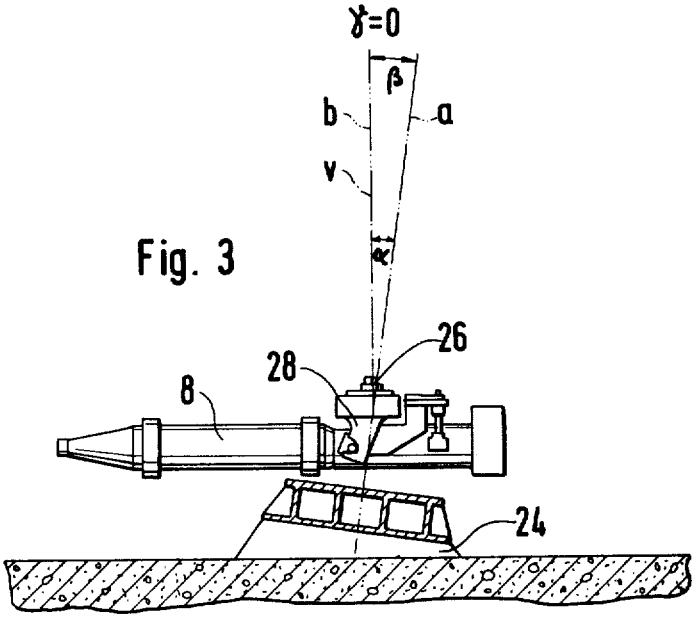
FIG. 3 shows a side view of the mechanism shown in FIG. 2 with the tool moved 180° into the retracted position.

As shown in FIG. 3, the tool 8 is in the retracted position and auxiliary pivot 26 is inclined in an opposite direction to the main pivot 16 so that the total angle of tool 8 with respect to the vertical is equal to the difference between the angle $\alpha$ and $\beta$. In the case where the angles $\alpha$ and $\beta$ are equal, as shown in FIG. 3, the angle $\gamma$ is equal to zero and the tool is perfectly horizontal in the withdrawn position. Thus, access to the front end of the tool is possible. Although it is preferred that the angles $\alpha$ and $\beta$ be equal, it is also possible to have angles $\alpha$ and $\beta$ that are different. The only condition is that the sum of the angles $\alpha$ and $\beta$ be approximately equal to $\gamma$ which corresponds to the angle of inclination of the taphole. It should be understood that angles $\alpha$ and $\beta$ should be selected to obtain a trajectory which is suitable for use in the particular application.

Figure 4:
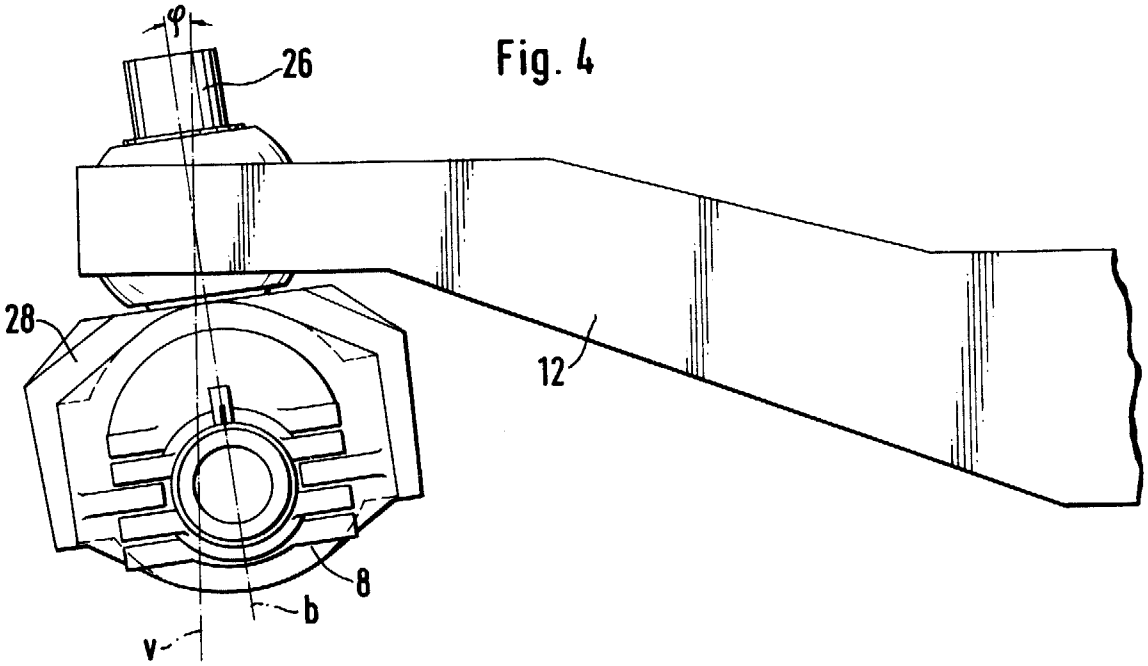
FIG. 4 shows a front elevational view of a tool positioned on its support arm.

The angle of inclination of auxiliary pivot 26 may be such that the axis "b" will be situated in a vertical plane passing through the axis of taphole 30 when the clay gun 8 occupies its operative position. The auxiliary pivot 26 will then be said to be inclined in a single direction. However, it is also possible, and, may even be of considerable advantage, for the auxiliary pivot 26 to be inclined in a second direction. As shown in FIG. 4, which shows an enlarged side view of arm 12 and a frontal view of tool 8, the tool 8 is affixed to arm 12 by means of fork 28 and pivot 26. FIG. 4 shows the axis "b" of auxiliary pivot 26 as being inclined at an angle $\phi$ with respect to the vertical "v" in a plane passing through the longitudinal axis of arm 12. This angle of inclination may be in the direction as that shown in FIG. 4 or may be in a direction opposite to that shown in FIG. 4 depending on the requirements of a particular system.

The advantages of either a single angle of inclination of auxiliary pivot 26 or a double angle of inclination of auxiliary pivot 26 are demonstrated by the series of curves in FIGS. 5 and 6. FIGS. 5 and 6 show a working platform 34 spaced from a tap floor a predetermined distance. A platform of this type may be up to 8 meters in width and its height from the pouring floor hardly exceeding 2.5 meters. The curves shown in FIGS. 5 and 6 show a clay gun having an angle of inclination with respect to the horizontal of 15° when it occupies its operative position. However, it should be understood that the angle of inclination can be more or less than 15°. Referring to FIGS. 5 and 6 curve B corresponds to curve B of FIG. 1 and shows the trajectory followed by the nose of clay gun in a conventional installation. Likewise, curve C shows the minimum height required to enable the clay gun to be pivoted between the operative position and the retracted position, that is, the approximate path of the highest point on the clay gun in a conventional installation. Curve C passes through working platform 34 so that it is either impossible to have a wide platform, or, the platform must be constructed to have apertures at defined points.

Curve D shows the trajectory of the nose of a clay gun wherein the main pivot forms an angle of 7.5 degrees in the direction of the furnace in a plane parallel to the taphole. Auxiliary pivot 26 forms an angle $\beta$ of 7.5 degrees in accordance with FIGS. 2 and 3 wherein angle $\beta$ is in one direction. In the operative position, the clay gun is moved to a 15° angle of inclination since the sum of the angles $\alpha$ and $\beta$ is equal to 15°. However, as clearly shown in FIG. 5, the gradient of curve D is much less steep than that of curve B so that the entire trajectory D of the clay gun is below working platform 34.

The curves E and F correspond to the curves B and C respectively and have been calculated point by point for a plugging device in which $\beta=7.5°$ and $\beta=7.5°$ and in which the angle $\phi$, in accordance with FIG. 4, is equal to 10°. The dotted lines in FIG. 5 show a clay gun moved by means of this device and in position in which it is approximately at its maximum height over the pouring floor 32. In these two diagrams the whole of the curve F is below the platform 34, i.e. the movement of the clay gun is unimpeded by the latter and vice versa In the embodiment of the invention where the auxiliary pivot 26 has an axis which is tilted in two directions as shown in FIG. 4, an additional advantage is obtained in that the curve E is quite steep at the outset so that when the tool 8 is near taphole 30, the tool will avoid contact with lateral flanks 38 and 40 when moved from the operative position toward the retracted position and vice versa. Moreover, since the trajectory defined by curve E reaches its maximum height more rapidly than in the case of trajectory D the arrangement set forth in the aforementioned application No. 943,223 whereby the plugging mechanism passes above a driling mechanism can be more easily designed. Once the maximum height of curve E is reached, the curve extends substantially horizontally below platform 34 and then descends rapidly to the retracted position. Thus, the embodiment of the invention set forth in FIG. 4 has many advantages. The trajectory and the tool has a relatively rapid ascent and descent at the operative and retracted positions thereby enabling the tool to avoid contacting the lateral flanks 38 and 40 of the trough and to avoid obstacles such as a second tool which may be positioned between the operative and retracted position of the first tool.

The present invention makes it possible, by the selection of suitable magnitudes of angles $\alpha,\beta$, and also optionally by selection of suitable magnitude of angle $\phi$, to move the tool over the desired curve to allow for avoidance of obstacles and provide for a relatively steep trajectory of the tool at the operational and retracted points of the trajectory. A particular advantage of the equipment of the present invention resides in the fact that the equipment requires little or no additional equipment over that used in conventional systems. Thus, by providing a mechanism for guiding and positioning a tool wherein the axis of the main pivot and the axis of the secondary pivot are oblique, a number of important advantages may be obtained without additional investment cost in comparison with prior art mechanisms.

We claim:

1. In apparatus for positioning and supporting a drill relative to a taphole of a shaft furnace, the furnace having a generally vertically oriented axis, the positioning and supporting apparatus having support arm means for pivoting about a first axis inclined with respect to the furnace axis, the drill having a longitudinal axis and being pivotally mounted from the support arm means so that the drill axis is rotatable about a second axis which is not parallel to said first axis, the improvement comprising:

pivot means for connecting the drill to the support arm means, said pivot means defining said second axis, said second axis being inclined with respect to said first axis when the drill is in its operative position, said first and second axes lying in planes which intersect at an oblique angle.

2. In apparatus for positioning and supporting a clay gun relative to a taphole of a shaft furnace, the furnace having a generally vertically oriented axis, the positioning and supporting apparatus including support arm means mounted for pivoting about a first axis inclined with respect to the furnace axis, the clay gun having a longitudinal axis and being pivotally mounted from the support arm means so that the clay gun is rotatable about a second axis which is not parallel to said first axis, the improvement comprising:

pivot means for connecting the clay gun to the support arm means, said pivot means defining said second axis, said second axis when the drill is in its operative position being inclined with respect to said first axis, said first and second axes lying in planes which intersect at an oblique angle.

3. In apparatus for positioning and supporting a tool relative to a taphole of a shaft furnace, the furnace having a generally vertically oriented axis and the axis of the taphole being inclined with respect to the horizontal, the positioning and supporting apparatus including support arm means mounted for pivoting about the first axis inclined with respect to the furnace axis, the tool having a longitudinal axis and being pivotally mounted from the support arm means so that the tool axis is rotatable about a second axis which is not parallel to said first axis, the improvement comprising:

pivot means for connecting the tool to the support arm means, said pivot means defining said second axis, said second axis being inclined with respect to said first axis when the tool is in its operative position, the sum of the angles of inclination of the first axis with respect to the furnace axis and the second axis with respect to the first axis being approximately equal to the angle of inclination of the taphole axis with respect to the horizontal, said first and second axes lying in planes which intersect at an oblique angle.

4. In apparatus for positioning and supporting a tool relative to a taphole of a shaft furnace, the furnace having a generally vertically oriented axis, the positioning and supporting apparatus including support arm means mounted for pivoting about the first axis inclined with respect to the furnace axis, the tool having a longitudinal axis and being pivotally mounted for the support arm means so that the tool axis is rotatable about a second axis which is not parallel to said first axis, the improvement comprising:

pivot means for connecting the tool to the support arm means, said pivot means defining said second axis, said second axis being inclined with respect to said first axis and lying in a vertical plane when the tool is in its operative position relative to the furnace taphole, the axis of the taphole also lying in said vertical plane, said first and second axes lying in planes which intersect at an oblique angle.

5. The apparatus of claim 4 wherein the axis of the taphole is inclined with respect to the horizontal and wherein the sum of the angles of inclination of the first axis with respect to the furnace axis and the second axis with respect to the first axis is approximately equal to the angle inclination of the taphole axis with respect to the horizontal.

6. In apparatus for positioning and supporting a tool relative to a taphole of a shaft furnace, the furnace having a generally vertically oriented axis, the positioning and supporting apparatus having support means mounted for pivoting about a first axis inclined with respect to the furnace axis, said support arm means including an elongated support arm having a longitudinal axis, said support arm longitudinal axis and said first axis intersecting adjacent a first end of said arm, the tool having a longitudinal axis and being pivotally mounted from the support arm means adjacent the second end of said arm whereby the tool axis is rotatable about a second axis, said first axis and the longitudinal axis of said support arm defining a first plane, the improvement comprising:

pivot means for connecting the tool to the support arm means, said pivot means defining said second axis which is not parallel to said first axis, said second axis and the longitudinal axis of said support arm defining a second plane, said second axis and the longitudinal axis of the tool defining a third plane which intersects said second plane at said second axis, said first and second planes intersecting at an oblique angle, said second axis also lying at the intersection of said second plane with a vertical plane perpendicular to said first and second planes, said second axis further being inclined with respect to the horizontal when the tool is in the operative position.

7. The apparatus of claim 6 wherein said third plane is vertical when the tool is in its operative position relative to the taphole.

8. The apparatus of claim 6 wherein said second and third planes are both inclined with respect to the vertical when the tool is in its operative position relative to the taphole.

9. An apparatus for positioning and supporting a tool relative to a taphole of a shaft furnace, the furnace having a generally vertically oriented axis, the positioning and supporting apparatus including support arm means mounted for pivoting about a first axis inclined with respect to the furnace axis, the tool having a longitudinal axis and being pivotally mounted from the support arm means so that the tool axis is rotatable about a second axis which is not parallel to said first axis, the improvement comprising:

pivot means for connecting the tool to the support arm means, said pivot means defining said second axis, said second axis being inclined in a first direction so as to intersect a first vertical plane which includes the tool axis when the tool is in its operative position relative to the taphole, said second axis further being inclined in a second direction so as to intersect a second vertical plane which is orthogonal to said first plane when said tool is in the said operative position, the second direction of inclination being inclined with respect to the first axis.

10. The apparatus of claim 9 wherein the axis of the taphole is inclined with respect to the horizontal and wherein the sum of the angles of inclination of the first axis with respect to the furnace axis and of the second direction of the second axis with respect to the first axis is approximately equal to the angle of inclination of the taphole axis with respect to the horizontal.

11. The apparatus of claim 9 wherein said tool is a drill.

12. The apparatus of claim 9 wherein said tool is a clay gun.

* * * * *